US007253370B2

(12) United States Patent
Chen et al.

(10) Patent No.: US 7,253,370 B2
(45) Date of Patent: Aug. 7, 2007

(54) COMPUTER BUTTON APPARATUS

(75) Inventors: Yun-Lung Chen, Tu-Cheng (TW); Quan-Guang Du, Shenzhen (CN)

(73) Assignees: Hong Fu Jin Industry (Shenzhen) Co., Ltd., Bao-an District, Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/288,918

(22) Filed: Nov. 29, 2005

(65) Prior Publication Data

US 2006/0243577 A1 Nov. 2, 2006

(30) Foreign Application Priority Data

Apr. 29, 2005 (CN) ..... 2005 2 0057954

(51) Int. Cl.
*H01H 13/14* (2006.01)
*H01H 3/12* (2006.01)

(52) U.S. Cl. ..... 200/341; 200/293; 200/296; 200/520

(58) Field of Classification Search ..... 200/341
See application file for complete search history.

(56) References Cited

U.S. PATENT DOCUMENTS

| | | | | |
|---|---|---|---|---|
| 5,862,071 | A * | 1/1999 | Scholder | 365/52 |
| 6,066,816 | A * | 5/2000 | Benger | 200/296 |
| 6,160,232 | A | 12/2000 | Lin | |
| 6,278,069 | B1 * | 8/2001 | Lee et al. | 200/16 C |
| 6,960,732 | B1 * | 11/2005 | Spiegel et al. | 200/296 |

* cited by examiner

*Primary Examiner*—Elvin Enad
*Assistant Examiner*—Lheiren Mae A. Anglo
(74) *Attorney, Agent, or Firm*—Morris Manning & Martin, LLP; Tim Tingkang Xia, Esq.

(57) ABSTRACT

A computer button apparatus includes a switch (30), an opening (12) defined in a panel (11), a bracket (40) receiving the switch, and a button (20). A plurality of flanges extends from the edges of the opening. A plurality of protrusions (134) is formed on the flanges. The bracket includes a pair of hooks (43). The button comprises a pair of clasps (25) for actuating the switch. The bracket is mounted on one side of a panel corresponding to the opening by the hooks engaging with the flanges and the protrusions retaining the bracket. The button is mounted on the opposite side of the panel corresponding to the opening by the clasps engaging with the flanges.

14 Claims, 5 Drawing Sheets

COMPUTER BUTTON APPARATUS

BACKGROUND OF THE INVENTION

1. Field of the Invention

The present invention relates to computer button apparatuses, and more particularly to a computer button apparatus which can be readily assembled to a computer.

2. General Background

A computer bezel normally has a plurality of buttons for controlling switches which are mounted on a front panel of a computer. The switches are connected to a circuit board of the computer. A button on the computer bezel is pressed to trigger a switch on the front panel thereby controlling an electrical apparatus of the computer.

A conventional push button assembly adapted to be mounted to a bezel includes a button body and a pair of anchoring members arranged on opposite sides of the button body and connected to the button body by resilient arms for resiliently supporting the button body. Each anchoring member forms a plurality of ledges for being interferentially inserted into and engaging with corresponding holes defined in the bezel thereby mounting the button body to the bezel. The bezel defines a bore through which a post extending from the button body extends for being accessible to a user. The button body has an inner end adapted to drivingly engage with a switch whereby when the post is depressed, the button body moves under the resilient support of the resilient arms to engage with and thus actuate the switch. But because the push button assembly is secured to the bezel by the ledges inserted into the holes, the push button assembly often breaks off the bezel after being used for a long time.

What is needed, therefore, is a computer button apparatus that can be readily directly mounted on the computer, and remain firmly affixed on the computer even after repeated use over time.

SUMMARY

A computer button apparatus includes a switch, an opening defined in a panel, a bracket receiving the switch, and a button. A plurality of flanges extend from the edges of the opening. A plurality of protrusions is formed on the flanges. The bracket includes a pair of hooks. The button comprises a pair of clasps for actuating the switch. The bracket is mounted on one side of the panel corresponding to the opening by the hooks engaging with the flanges and the protrusions retaining the bracket. The button is mounted on the opposite side of the panel corresponding to the opening by the clasps engaging with the flanges.

Other advantages and novel features will be drawn from the following detailed description of a preferred embodiment with attached drawings, in which:

DETAILED DESCRIPTION OF THE EMBODIMENTS

Figure 1:
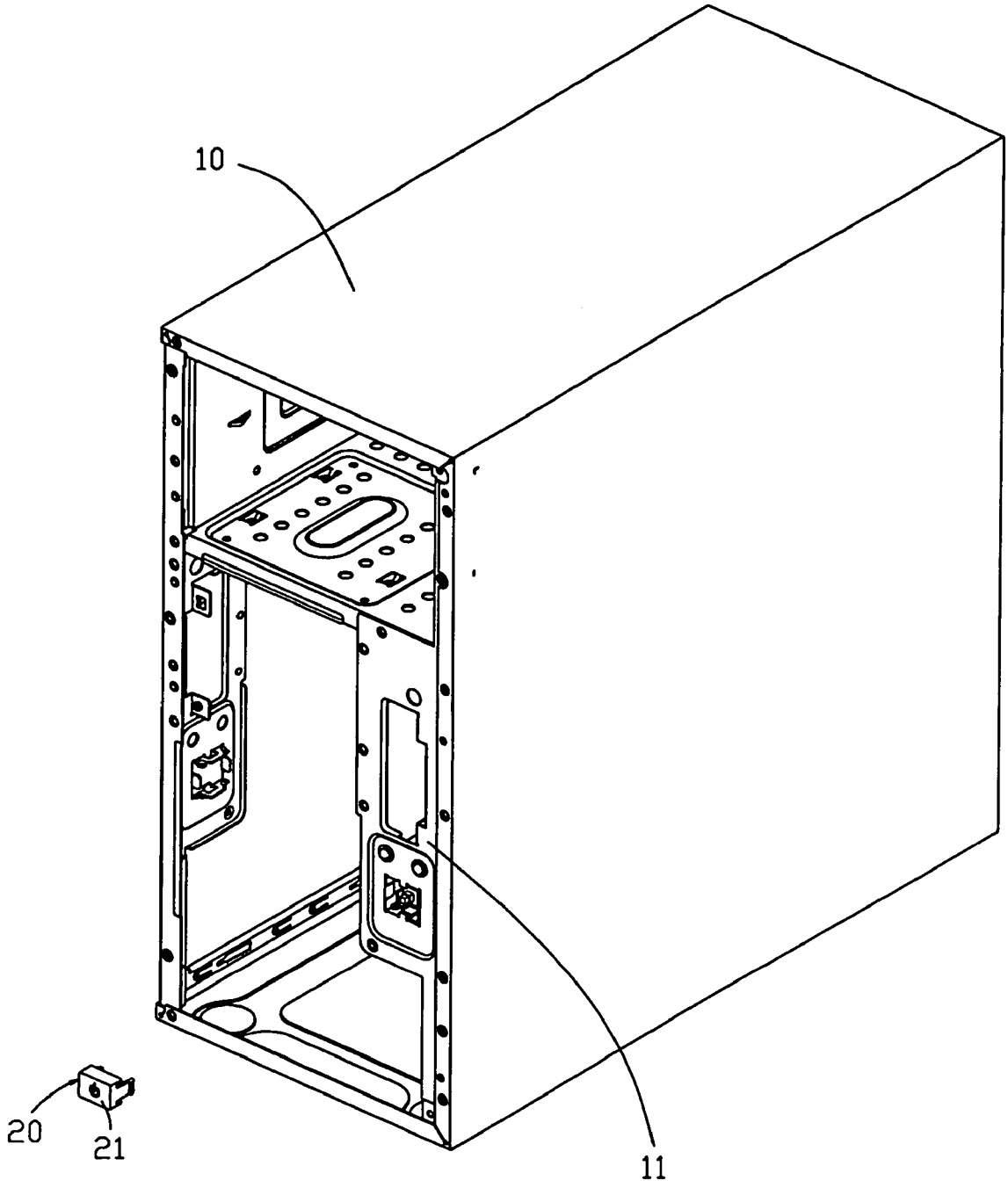
FIG. 1 is an exploded, isometric view of a preferred embodiment of a computer button apparatus pre-mounted on a front panel of a computer.
Figure 2:
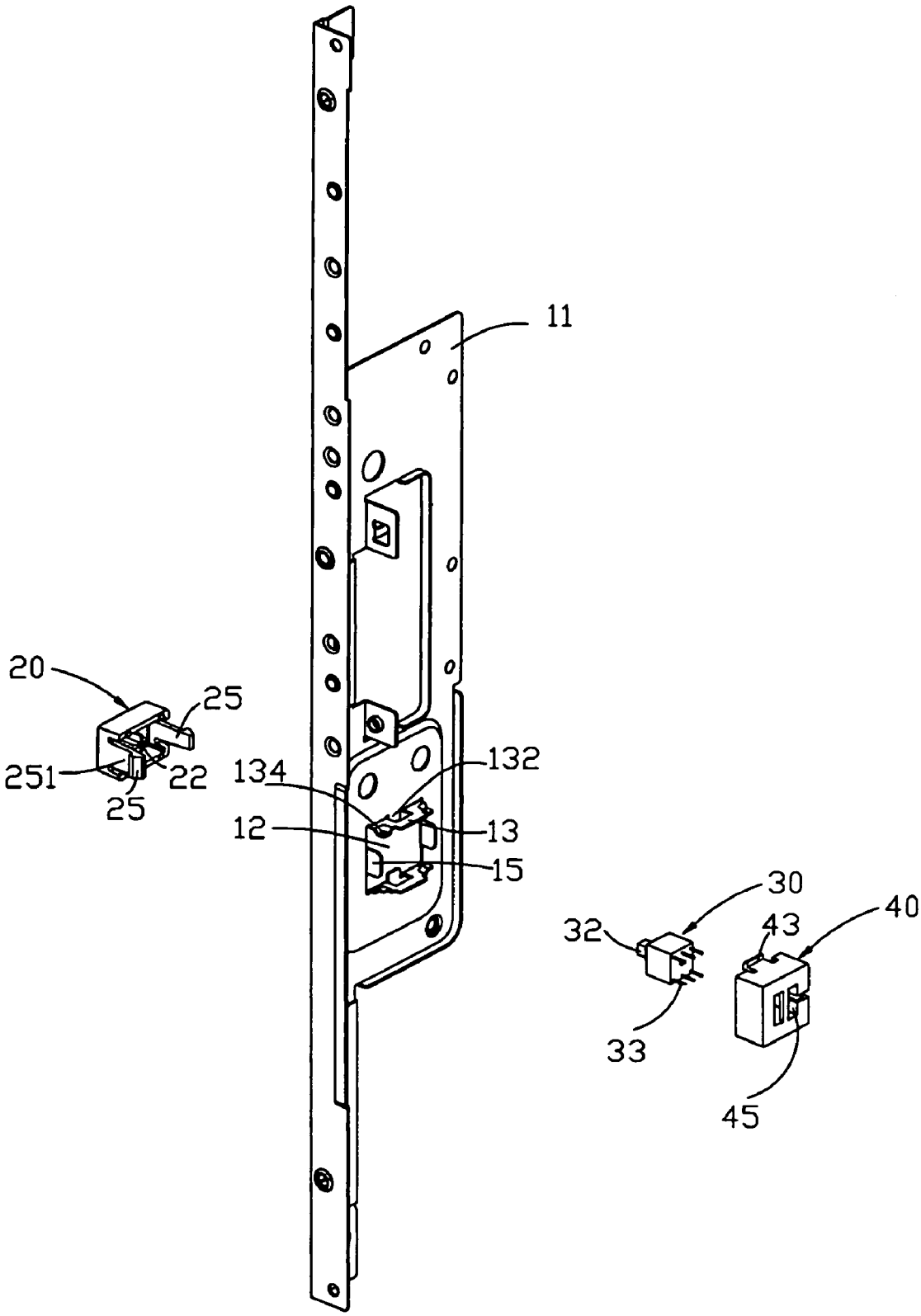
FIG. 2 is an exploded, isometric view of the computer button apparatus of FIG. 1.
Figure 3:
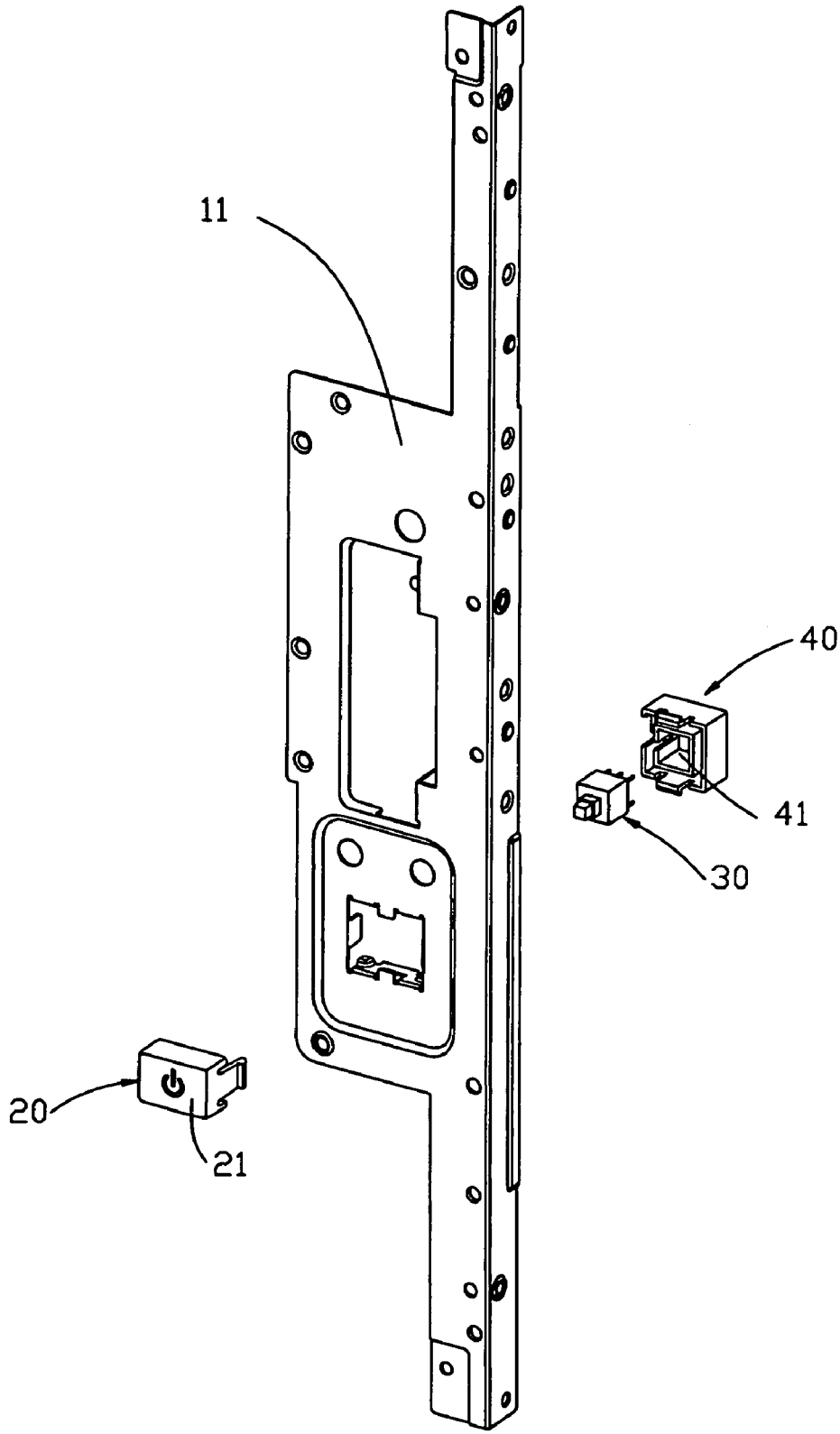
FIG. 3 is similar to FIG. 2, but viewed from another aspect.

Referring to FIGS. 1, 2, and 3, a button apparatus of an electronic device like a computer in accordance with a preferred embodiment of the present invention is embodied with part of a front panel 11 of a computer chassis 10. The computer button apparatus includes a button 20, a switch 30 as a component of the computer, and a bracket 40.

An opening 12 is defined in the front panel 11. A pair of first flanges 13 extends rearwardly from a top edge and a bottom edge of the opening 12 respectively. Each first flange 13 defines a slot 132 therein, and two protrusions 134 being opposite to the other first flange 13 are formed thereon. A pair of second flanges 15 extend rearwardly from a left edge and a right edge of the opening 12 respectively.

The button 20 is generally a square member which includes a pressing surface 21 exposed to the user, a post 22 extending from a rear side of the pressing surface 21, and a pair of clasps 25 extending rearward from opposite edges of the pressing surface 21. Each clasp 25 includes a resilient arm 251.

The switch 30 is a common switch which includes an actuating portion 32 and a plurality of pins 33 protruding from opposite ends of the switch 30.

The bracket 40 includes a housing 41 and a pair of elastic hooks 43. The housing 41 is used for receiving the switch 30 therein. Two slits 45 are defined in the back of the bracket 40 communicating with the housing 41.

Figure 4:
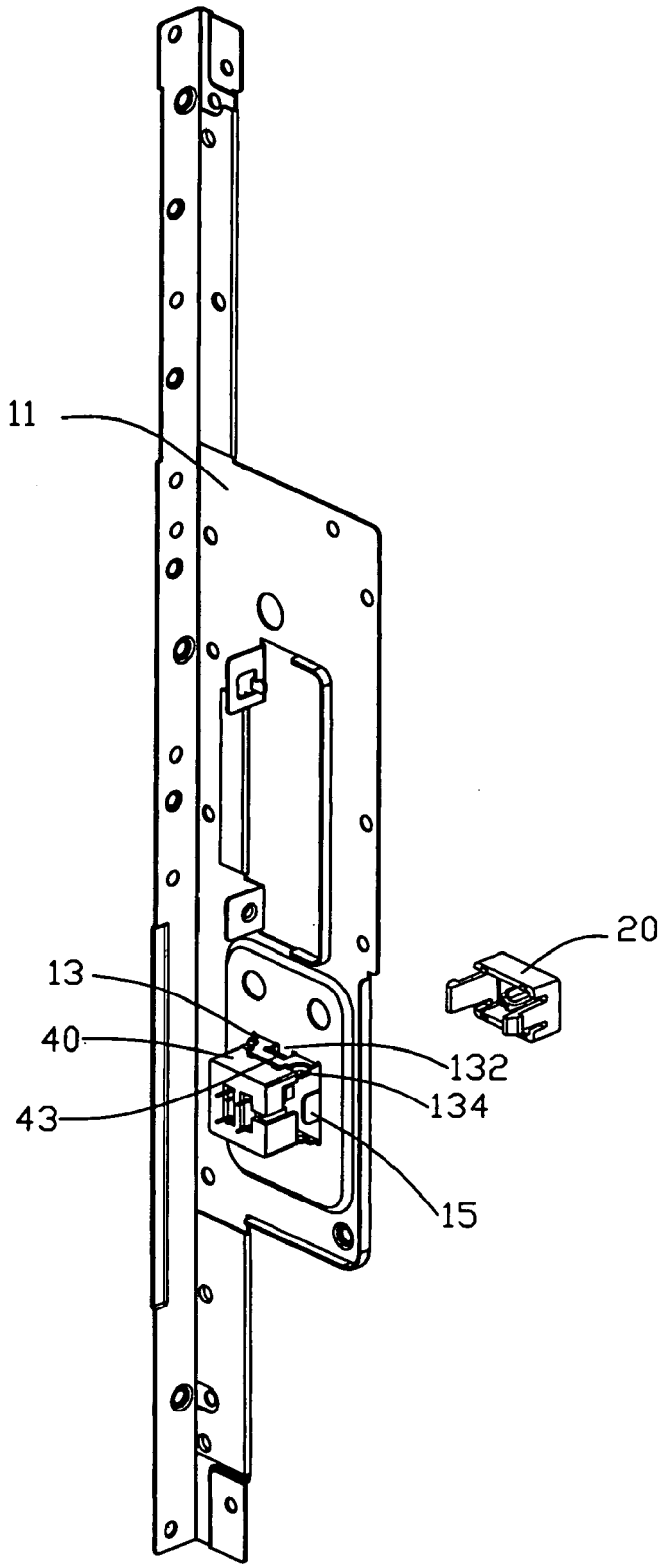
FIG. 4 is a partially assembled view of the computer button apparatus of FIG. 1.
Figure 5:
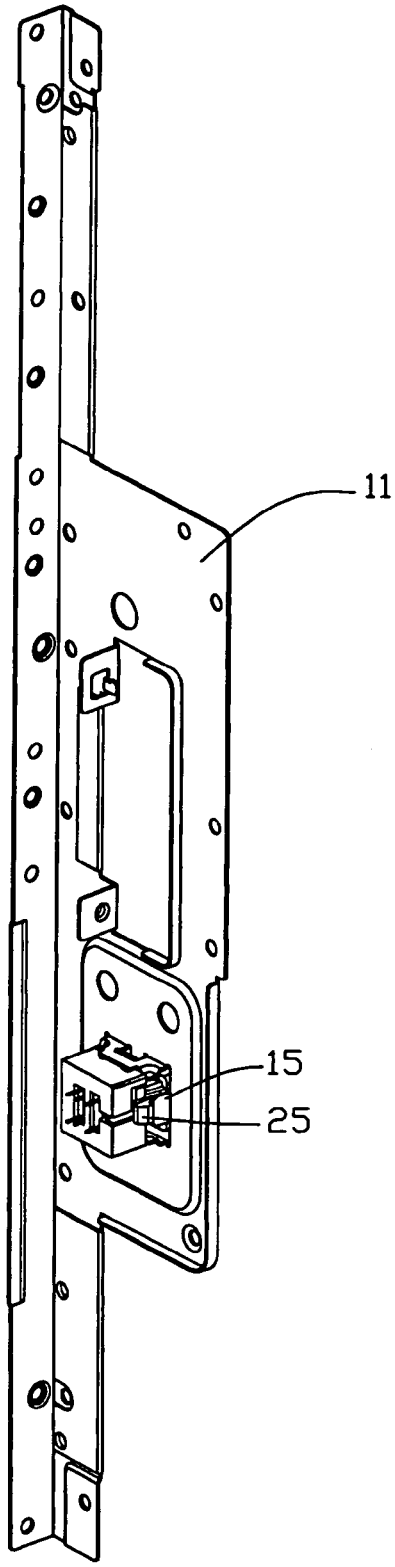
FIG. 5 is an assembled view of the computer button apparatus of FIG. 1.

Referring also to FIGS. 4 and 5, in assembly, the switch 30 is placed into the housing 41 with the pins 33 extending through the slits 45 of the bracket 40. The bracket 40 moves towards the front panel 11 from a rear side of the front panel 11, and the hooks 43 of the bracket 40 are elastically deformed by the first flanges 13. The bracket 40 moves until the hooks 43 engage with the slots 132 to mount the bracket 40 to the front panel 11. At the same time, the protrusions 134 of the first flanges 13 restrict the bracket 40 thereof.

Then, the button 20 moves towards the front panel 11 from a front side of the front panel 11, and the resilient arms 251 of the clasps 25 are elastically deformed by the second flanges 15. The button 20 moves until the clasps 25 engage the ends of the second flanges 15 thereby mounting the button 20 to the front panel 11. Each resilient arm 251 is tightly sandwiched between the second flanges 15 and the bracket 40. The post 22 of the button 20 abuts against the actuating portion 32 of the switch 30. The button 20 is in view of users when a bezel (not shown) is mounted on the chassis 10. In use, the button 20 is pressed to cause the post 22 to press the actuating portion 32 of the switch 30 thereby triggering the switch 30.

It is to be understood, however, that even though numerous characteristics and advantages have been set forth in the foregoing description of a preferred embodiment, together with details of the structure and function of the embodiment, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A computer button apparatus comprising:

a switch;

an opening defined in a panel, a plurality of flanges extending from the edges of the opening, a plurality of protrusions formed on the flanges;

a bracket receiving the switch therein, the bracket comprising a plurality of hooks; and a button for actuating the switch, the button comprising a plurality of clasps;

wherein the bracket is mounted on one side of the panel corresponding to the opening by the hooks engaging with the flanges and the protrusions retaining the bracket, and the button is mounted on the opposite side of the panel corresponding to the opening near the clasps engaging the flanges;

wherein the plurality of flanges comprise a pair of first flanges formed on opposites edges of the opening, and each first flange defines a slot for engaging with the hook.

2. The computer button apparatus as described in claim 1, wherein the protrusions are formed on the first flanges.

3. The computer button apparatus as described in claim 1, wherein the plurality of flanges comprises a pair of second flanges for the clasps engaging with ends of the second flanges to mount the button on the panel.

4. The computer button apparatus as described in claim 3, wherein the clasp comprises a resilient arm sandwiched between the second flanges and the bracket.

5. The computer button apparatus as described in claim 1, wherein the switch comprises an actuating portion, and the button comprises a post abutting against the actuating portion.

6. The computer button apparatus as described in claim 1, wherein the bracket comprises a housing for receiving the switch.

7. The computer button apparatus as described in claim 1, wherein the switch comprises a plurality of pins, and the bracket defines a slit for the pins extending therethrough.

8. A computer button apparatus comprising:

a switch;

an opening defined in a panel, a plurality of flanges extending from edges of the opening;

a bracket receiving the switch therein, the bracket comprising a plurality of hooks engaging with the flanges to mount the bracket on one side of the panel corresponding to the opening; and a button comprising a plurality of clasps engaging with the flanges to mount the button on the opposite side of the panel corresponding to the opening for actuating the switch;

wherein the plurality of flanges comprise a pair of first flanges for the clasps engaging with ends of the first flanges to mount the button on the panel, and each of the claps comprises a resilient arm sandwiched between the first flanges and the bracket.

9. The computer button apparatus as described in claim 8, wherein the plurality of flanges comprises a pair of second flanges formed on opposites edges of the opening, and each second flange defines a slot for the hook engaging therewith.

10. The computer button apparatus as described in claim 9, wherein a plurality of protrusions is formed on the second flanges for restricting the bracket.

11. The computer button apparatus as described in claim 8, wherein the switch comprises an actuating portion, and the button comprises a post abutting against the actuating portion.

12. The computer button apparatus as described in claim 8, wherein the bracket comprises a housing for receiving the switch.

13. The computer button apparatus as described in claim 8, wherein the switch comprises a plurality of pins, and the bracket defines a slit for the pins extending through.

14. An electronic device comprising:

a chassis of said electronic device defining an outline at a side thereof, a plurality of flanges formed at said side of said chassis;

a component of said electronic device to be triggered for performing predetermined function of said electronic device;

a bracket removably attachable to said side of said chassis inside said outline of said chassis and defining a first space therein inside said chassis beside said outline; and a button exposable to an outside of said electronic device, said button comprising a plurality of clasps engaging with ends of said flanges to movably attach said button to said side of said chassis outside said outline of said chassis, said button defining a second space therein spatially communicable with said first space of said bracket so as to cooperatively receive said component in both of said first and second spaces together with said bracket, and movement of said button relative to said outline of said chassis capable of triggering said component to perform said function;

wherein said bracket comprises a plurality of hooks, said plurality of flanges comprises first flanges, and each of said first flanges defines a slot for each of said plurality of hooks engaging therewith.

* * * * *